US007135237B2

(12) United States Patent
Goto et al.

(10) Patent No.: US 7,135,237 B2
(45) Date of Patent: Nov. 14, 2006

(54) HOT-DIPPED SN—ZN PLATING PROVIDED STEEL PLATE OR SHEET EXCELLING IN CORROSION RESISTANCE AND WORKABILITY

(75) Inventors: Yasuto Goto, Kitakyushu (JP); Shinichi Yamaguchi, Kitakyushu (JP); Masao Kurosaki, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/531,071

(22) PCT Filed: Oct. 9, 2003

(86) PCT No.: PCT/JP03/12999

§ 371 (c)(1),
(2), (4) Date: May 13, 2005

(87) PCT Pub. No.: WO2004/033745

PCT Pub. Date: Apr. 22, 2004

(65) Prior Publication Data

US 2006/0003180 A1 Jan. 5, 2006

(30) Foreign Application Priority Data

Oct. 11, 2002 (JP) ..... 2002-298691
Oct. 11, 2002 (JP) ..... 2002-298692

(51) Int. Cl.
*B32B 15/01* (2006.01)
*B32B 15/04* (2006.01)
*B32B 15/18* (2006.01)

(52) U.S. Cl. ..... 428/648; 428/612; 428/684

(58) Field of Classification Search ..... 428/658, 428/659, 646, 648, 681, 684, 685, 687, 612
See application file for complete search history.

(56) References Cited

U.S. PATENT DOCUMENTS 6,649,282 B1 * 11/2003 Yamaguchi et al. ..... 428/648

FOREIGN PATENT DOCUMENTS

| | | |
|---|---|---|
| JP | 2000-119833 | 4/2000 |
| JP | 2002-317233 | * 10/2002 |
| WO | WO 96/30560 | 10/1996 |

* cited by examiner

*Primary Examiner*—Michael E. La Villa
(74) *Attorney, Agent, or Firm*—Kenyon & Kenyon LLP

(57) ABSTRACT

A Pb-free hot-dip Sn—Zn coated steel sheet comprising a hot-dip coating layer comprised of 1 to 8.8 wt % of Zn and the balance of Sn in an amount of 91.2 to 99.0 wt % and unavoidable impurities and/or ancillary ingredients on the surface of steel sheet, the coating surface having Sn dendrite crystals and Sn dendrite arm spacings buried by an Sn—Zn two-way eutectic structure, an area ratio of Sn dendrites in the coating surface being 5 to 90%, and the arm spacing of the Sn dendrites being not more than 0.1 mm, preferably having a discontinuous $FeSn_2$ alloy phase at the surface of the steel sheet.

5 Claims, 1 Drawing Sheet

HOT-DIPPED SN—ZN PLATING PROVIDED STEEL PLATE OR SHEET EXCELLING IN CORROSION RESISTANCE AND WORKABILITY

TECHNICAL FIELD

The present invention relates to hot-dip Sn—Zn-alloy-coated steel sheet provided with superior corrosion resistance, weldability, and workability and suitable as a material for an automobile fuel tank, household electrical appliances, and industrial machinery.

BACKGROUND ART

In the past, as the material for fuel tanks, Pb—Sn-alloy-coated steel sheet superior in corrosion resistance, workability, solderability (weldability), etc. has mainly been used. This has been broadly used for automobile fuel tanks. On the other hand, Sn—Zn-alloy-coated steel sheet, for example as shown in Japanese Unexamined Patent Publication (Kokai) No. 52-130438, has mainly been produced by electroplating involving electrolysis in an aqueous solution including Zn and Sn ions. Sn—Zn-alloy-coated steel sheet having Sn as a main ingredient is superior in corrosion resistance and solderability and has been made much use of for electronic components etc.

Further, Sn-coated steel sheet is being made wide use of mainly for food can and beverage can applications due to the superior corrosion resistance and workability of Sn. However, it is known that while Sn has a sacrificial corrosion protection ability for the base iron in an environment free of dissolved oxygen such as the inside of a food can, it has the defect of easily progression of corrosion from the base iron in environments with oxygen present. As technology for making up for this, the technology of applying steel sheet coated with Sn—Zn alloy containing 20 to 40% Zn to electronic components, auto parts, and other after coating fields is disclosed in Japanese Unexamined Patent Publication (Kokai) No. 6-116794. However, this is by electroplating. In electroplating of Sn, the current density is low, so a high amount of deposition has been difficult to obtain for reasons of cost and productivity.

It was discovered that this Sn—Zn-alloy-coated steel sheet has superior properties in automobile fuel tank applications. Japanese Unexamined Patent Publication (Kokai) No. 8-269733 and Japanese Unexamined Patent Publication (Kokai) No. 8-269734 disclose hot-dip Sn—Zn-alloy-coated steel sheet.

The above-mentioned Pb—Sn alloy-coated steel sheet used as the material for automobile fuel tanks has been recognized as having various superior properties (for example, workability, corrosion resistance at the inside surface of the tank, solderability, seamless weldability, etc.) and has been favored in use, but along with the recent rising awareness of the global environment, a shift is occurring in the direction of Pb-free materials. On the other hand, Sn—Zn-alloy electroplated steel sheet has mainly been used for electronic components where solderability etc. are required, i.e., applications where the corrosive environment is not that severe.

Further, hot-dip Sn—Zn-alloy-coated steel sheet indeed has superior corrosion resistance, workability, and solderability. However, in recent years, further improvement of the corrosion resistance has been sought. In Sn—Zn-coated steel sheet, pitting due to Zn segregation sometimes occurs even at flat parts not subjected to any working, but in salt water spray tests envisioning salt corrosive environments, the time until occurrence of red rust is short, so the corrosion resistance in a salt corrosive environment cannot be said to be sufficient. To further improve the sacrificial corrosion protection ability, it is sufficient to increase the amount of addition of Zn, but if the amount of Zn is too high, the coating layer shifts from mainly Sn to Zn and the dissolution of Zn itself is far greater than Sn, so the corrosion resistance of the coating layer itself is impaired. Further, this hot-dip Sn—Zn-alloy-coated steel sheet has an alloy layer including at least one of Fe, Zn, and Sn. This alloy layer grows continuously thick. An alloy layer is a reaction product between the coating metal and the base iron and forms an intermetallic compound layer. Therefore, in general, it is a brittle layer. If grown thick, working will cause fractures leading to lamellar peeling at the inside. From this sense, a hot-dip Sn—Zn-alloy-coated steel sheet having a continuous thick alloy layer tended to be somewhat inferior in workability.

Further, Sn—Zn-alloy coated steel sheet having a thick alloy layer has a tendency for segregation of the Zn at the Sn—Zn solidified structure. This is because on a continuous homogeneous alloy layer, there are few nuclei for coating solidification, so a coarse solidified structure results. In a coarse solidified structure, segregation of Zn easily occurs, so an Sn—Zn-alloy-coated steel sheet tends to be somewhat inferior in corrosion resistance.

DISCLOSURE OF INVENTION

A first object of the present invention is to provide a hot-dip Sn—Zn-alloy-coated steel sheet having a good balance of corrosion resistance, workability, and weldability and not using Pb.

Further, a second object of the present invention is to provide a hot-dip Sn—Zn-alloy-coated steel sheet formed with a thick alloy layer so as to prevent a drop in the workability and corrosion resistance and having a good balance of workability and corrosion resistance.

The inventors engaged in various studies on coating compositions and structures for the purpose of providing rust-proof steel sheet not containing Pb and improved in rust-proofing performance and thereby reached the present invention. The present invention lies in a hot-dip Sn—Zn-alloy-coated steel sheet obtained by forming a hot-dip coating layer comprised of 1 to 8.8 wt % of Zn and the balance of Sn in an amount of 91.2 to 99.0 wt % and unavoidable impurities and/or ancillary ingredients on the surface of steel sheet, the hot-dip Sn—Zn-alloy-coated steel sheet characterized in that the coating surface having Sn dendrite crystals and Sn dendrite arm spacings buried by an Sn—Zn-alloy two-way eutectic structure. Preferably, the area ratio of Sn dendrites in the coating surface is 5 to 90%, and the arm spacing of the Sn dendrites is not more than 0.1 mm. Further, sometimes, under the coating layer, there is an alloy layer of a thickness of 3.0 μm or less containing one or more of Ni, Co, and Cu in a total of at least 0.5 wt % and sometimes the surface of the coating layer has a post-treatment layer comprised of an inorganic compound or organic compound or a complex of the same.

Further, the inventors took note of the $FeSn_2$ alloy phase produced at the interface of the Sn—Zn-alloy-coating layer and the base iron of the hot-dip Sn—Zn-alloy-coated steel sheet, investigated in detail its configuration and the properties of the coated steel sheet, and discovered that by suitably controlling the alloy phase, higher performance can be obtained. They thereby completed the present invention.

The gist lies in the control of the distribution and roughness of the $FeSn_2$ alloy phase so as to obtain superior coating workability and corrosion resistance. The gist of the present invention is as follows:

(1) Hot-dip Sn—Zn coated steel sheet superior in corrosion resistance and workability characterized by comprising hot-dip Sn-based coated steel sheet obtained by forming a hot-dip coating layer comprised of 1 to 8.8 wt % of Zn and the balance of Sn in an amount of 91.2 to 99.0 wt % and unavoidable impurities and/or ancillary ingredients on the surface of steel sheet, the coating surface having Sn dendrite crystals and Sn dendrite arm spacings buried by an Sn—Zn two-way eutectic structure.

(2) Hot-dip Sn—Zn coated steel sheet superior in corrosion resistance and workability as set forth in (1), characterized in that an area ratio of Sn dendrites in the coating surface is 5 to 90%.

(3) Hot-dip Sn—Zn coated steel sheet superior in corrosion resistance and workability as set forth in (1) or (2), characterized in that the arm spacing of the Sn dendrites is not more than 0.1 mm.

(4) Hot-dip Sn—Zn coated steel sheet superior in corrosion resistance and workability as set forth in any one of (1) to (3), characterized by having a discontinuous $FeSn_2$ alloy phase between the surface of the steel sheet and the hot-dip Sn—Zn-alloy coating, by having an area ratio of the $FeSn_2$ alloy phase of at least 1% and less than 100%, and having an Sn—Zn-alloy coating layer on top of that.

(5) Hot-dip Sn—Zn coated steel sheet superior in corrosion resistance and workability as set forth in (4), characterized in that a surface roughness of said discontinuous $FeSn_2$ alloy phase is 0.1 to 2.5 μm in terms of RMS.

BEST MODE FOR CARRYING OUT THE INVENTION

Figure 1:
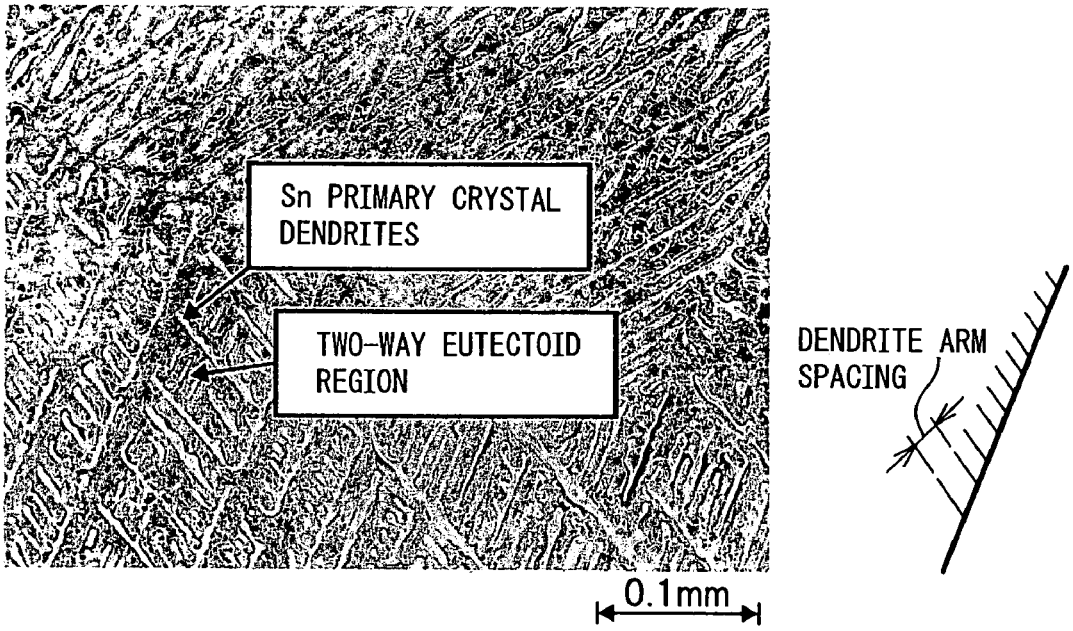
FIG. 1 is a view of a coating layer of the present invention.

Below, the present invention will be explained in detail.

Annealed steel sheet obtained by subjecting a steel slab to a series of processes including hot rolling, pickling, cold rolling, annealing, and temper-rolling or a rolled material is pretreated to remove the rolling oil or oxide film etc., then plated. The steel ingredients have to be ingredients enabling working to the complicated shape of a fuel tank, have to enable prevention of the alloy layer of the steel-coating layer interface from becoming thin and the coating from peeling off, and have to suppress the progression of corrosion at the environment inside and outside the fuel tank.

In the present invention, the Sn—Zn-alloy coating is basically performed by hot-dipping. The biggest reason for employing hot-dipping is securing the amount of coating deposition. With electroplating, the amount of coating deposition can be secured with a long period of electrolysis, but this is not economical. The range of coating deposition aimed at in the present invention is in the region of the relative thick deposition of 20 to 150 $g/m^2$ (single side). Hot-dipping is optimal. Further, when the potential difference of the coating elements is large, suitable control of the composition is fraught with difficulty, so for Sn—Zn alloys, hot-dipping is optimal.

Next, there is the reason for limitation of Zn in the coating composition. This is limited by the balance of the corrosion resistance at the inside surface and outside surface of the fuel tank. The outside surface of the tank is coated after forming the tank since complete rust-proofing ability is required. Therefore, the coating thickness determines the rust-proofing ability, but red rust is prevented by the corrosion protection effect of the coating layer of the material. In particular, at a location with poor coverage of the coating, the corrosion protection effect of the coating layer is extremely important. The addition of the Zn in the Sn-based coating lowers the potential of the coating layer and imparts a sacrificial corrosion protection ability. Therefore, addition of at least 1 wt % of Zn is necessary. The addition of excess Zn over the Sn—Zn two-way eutectic point of 8.8 wt % causes Sn dendrites to no longer precipitate, causes a rise in melting point, leads to excessive growth of the intermetallic compound layer under the coating, etc., so the amount has to be made not more than 8.8 wt %.

On the other hand, corrosion at the inside surface of the tank does not become a problem in the case of only normal gasoline, but a considerably severe corrosive environment is created by the intermixture of water, the intermixture of chlorine ions, the production of organic carboxylic acids due to oxidation degradation of the gasoline, etc. If a corrosion hole allows gasoline to leak to the outside of the tank, it may lead to a serious accident. These types of corrosion may be completely prevented. Degraded gasoline containing corrosion promoting ingredients was prepared and performance under various conditions was investigated, whereupon it was confirmed that an Sn—Zn-alloy-coating film containing Zn in an amount of not more than 8.8 wt % exhibits an extremely excellent corrosion resistance.

When the content of pure Sn not containing any Zn or the content of Zn is less than 1 wt %, the coating metal does not have a sacrificial corrosion protection ability with respect to the base iron from the initial stage of exposure to a corrosive environment, so pitting at pinhole parts at the inside surface of the tank and early occurrence of red rust at the outside surface of the tank become problems. On the other hand, if Zn is included in a large amount exceeding 8.8 wt %, the Zn will preferentially dissolve and a large amount of corrosion products will be produced in a short time, so there is the problem of easy clogging of the carburetor. Further, by the content of Zn becoming greater, the workability of the coating layer also falls and the good press formability of an Sn-based coating is impaired. Further, by the content of Zn becoming greater, the solderability greatly declines due to the rise in the melting point of the coating layer and the Zn oxides.

Therefore, the content of Zn in the Sn—Zn-alloy coating in the present invention is preferably made a range of 1 to 8.8 wt %, in particular a range of 3.0 to 8.8 wt % in order to obtain a more sufficient sacrificial corrosion protection action.

Further, including ancillary ingredients in the coating layer for the purpose of the corrosion resistance etc. of the coating layer does not detract from the intent of the present invention.

For example, to improve the corrosion resistance, it is possible to include one or more of In, Bi, Mg, Cu, Cd, Al, S, Ti, Zr, Hf, Pb, As, Sb, Fe, Co, and Ni in a total of not more than 1 wt %.

Next, there are the reasons for limitation of the coating structure. In the present invention, this is the most important. The structure is limited by the balance between the corrosion resistances at the inside surface and outside surface of the fuel tank and the production ability and is characterized by the coating surface having Sn dendrite crystals and Sn dendrite arm spacings buried by an Sn—Zn two-way eutectic structure.

Zn, as explained above, imparts a sacrificial corrosion protection ability in the Sn-based coating and thereby controls the corrosion at the inside and outside surfaces of the tank, but in a corrosive environment, since the Zn itself inherently has a fast speed of dissolution, if there is a Zn segregation zone in the coating layer, just that location ends up dissolving preferentially and a corrosion hole easily ends up occurring at that location.

In the coating composition of the present invention, normally the hot-dip Sn—Zn-alloy coating structure becomes a solidified structure of the primary crystal Sn and spangle-shaped two-way eutectic structure mixed together. At this time, the Zn particularly easily segregates at the spangle-spangle grain boundaries. The reason why the Zn easily segregates at the spangle-spangle grain boundaries is not clear, but it is believed that the minute amount of impurities with affinity with Zn have an effect. The Zn segregating at spangle-spangle grain boundaries, as explained above, form starting points of corrosion and cause a state where corrosion holes easily occur.

Such Zn segregation can be eliminated by positively causing the development of primary crystal Sn as dendrites and suppressing the growth of spangles. Since the Sn precipitates as primary crystals in the region of composition of the present invention, if the Sn dendrites are spread at the coating layer at the initial stage of solidification in a network shape, the spangle-shaped two-way eutectoids produced due to the eutectic reaction are suppressed in growth by the dendrite arms and cannot grow large. Therefore, giant spandles no longer bump against each other, there is no longer Zn segregated at the spangle-spangle grain boundaries, and the corrosion resistance at the inside and outside surfaces of the tank is remarkably improved.

To positively enable Sn dendrites to develop, the starting points of growth of the Sn dendrites may be increased. In the process of solidification in the hot-dipping, the heat loss at the steel sheet side is large. The coating solidifies from the boundary side of the coating/base iron. Therefore, if giving fine roughness to the alloy layer under the hot-dip coating layer or giving fine roughness to the base iron itself, it is possible to create starting points for growth of dendrites. To give fine roughness to the alloy layer, it is possible to control the alloying reaction between the hot-dip coating and the steel sheet. Specifically, the type of the pre-coating, the coating bath temperature, and the dipping time may be controlled. As the type of pre-coating, Ni, Co, or Cu alone or an alloy with Fe or alloys of these metals together are possible. As the amount of pre-coating, 0.01 to 2.0 g/m$^2$ or so is insufficient. Further, to give roughness to the surface of the base iron, it is sufficient to impart surface roughness in the rolling process before the hot dipping.

For example, before the hot dipping process, the steel sheet may be pre-electroplated with Ni to 0.1 g/m$^2$, then dipped in an Sn—Zn-alloy coating bath of a bath temperature of 240° C. for 5 seconds, then the coated steel sheet is pulled out from the Sn—Zn bath so as to cause the development of an alloy layer of a fine roughness of 1.5 μm in terms of RMS at the coating/base iron boundary, grow dendrites using the recesses of the alloy layer as starting points, and obtain a dendrite type solidified structure down to the topmost layer of the hot-dip coating.

Next, the area ratio of the Sn dendrites in the coating surface is desirably 5 to 90%. If less than 5%, the growth of the eutectoid spangles due to the Sn dendrites sometimes cannot be sufficiently suppressed. On the other hand, if over 90%, the absolute amount of the Zn is relatively insufficient and sacrificial corrosion protection can no longer function well at the coating layer as a whole in some cases. The amount of the Sn dendrites can be changed by controlling the coating composition and solidification rate.

Further, the Sn dendrite arm spacing is desirably not more than 0.1 mm. If the dendrite arm spacing is larger than 0.1 mm, eutectoid spangles will sometimes end up growing between the arms. In particular, the spangle-spangle grain boundaries where eutectoid spangles having diameters of at least 0.1 mm (in the case of an elliptical shape, the average of the long axis and short axis) bump against each other tend to become remarkably susceptible to Zn segregation. Therefore, from the viewpoint of not allowing the spangles to grow to a diameter of 0.1 mm or more, the dendrite arm spacing is desirably not more than 0.1 mm. The dendrite arm spacing may be reduced by increasing the starting points of growth of dendrites (increasing the fineness of the surface roughness of the coating/base iron) or increasing the solidification rate.

For example, right after pulling out the steel sheet from the Sn—Zn-alloy coating bath, it is possible to control the amount of deposition by wiping, then cool the coating to solidify it by an average cooling rate of 30° C./sec from 235° C. to 195° C. including the temperature region from the liquid phase linear temperature to the eutectic temperature so as to make the dendrite arm spacing not more than 0.1 mm.

In the present invention, complete corrosion resistance is expected by further post treatment of the surface of the coating layer by an inorganic compound or organic compound or a complex of the same. This treatment has extremely good affinity with the Sn—Zn-alloy coating layer. There is the effect of covering small pinholes and other defects or dissolving the coating layer to repair pinholes and greatly improves the corrosion resistance.

Next, the present invention has a discontinuous $FeSn_2$ alloy phase at the surface of the steel sheet. The area ratio of the $FeSn_2$ alloy phase was at least 1% and less than 100%. There was the above-mentioned Sn—Zn-alloy coating layer above that. Further, the surface roughness of the discontinuous $FeSn_2$ alloy phase was 0.1 to 2.5 μm in terms of RMS.

Further, in the present invention, "discontinuous" means the state where the entire surface of the steel sheet is not completely covered.

The area ratio of the discontinuous $FeSn_2$ alloy phase is made at least 1% and less than 100%. If less than 1%, almost no alloying proceeds, and the coating bondability of the upper Sn—Zn-alloy-coating layer remarkably drops. Further, if 100%, a continuous brittle alloy layer is formed, fractures occur at the time of working, and lamellar peeling is induced at the inside in some cases, so the workability tends become inferior.

Further, an Sn—Zn coated steel sheet having a continuous alloy layer is a solidified Sn—Zn structure where segregation of Zn tends to easily occur. This is because on a continuous alloy layer, there is little production of nuclei for coating solidification and a coarse solidified structure results. With a coarse solidified structure, segregation of Zn easily occurs and the Sn—Zn coated steel sheet tends to become somewhat inferior in corrosion resistance. Therefore, the area ratio of the $FeSn_2$ alloy phase is made less than 100%. The area ratio of the $FeSn_2$ alloy phase is more preferably made 3 to 90%.

The area ratio is defined by the rate of coverage of the $FeSn_2$ on the surface of the base iron. This is found by electrolytically peeling off only the Sn—Zn-alloy-coating layer in 5% NaOH or another peeling solution to expose the $FeSn_2$ alloy phase and observing the surface by an SEM (Scanning Electron Microscope), EPMA (Electron Probe Microanalyzer), etc. The base iron does not contain much Sn at all, so can be identified by the EPMA. Further, the $FeSn_2$ phase has a specific crystal form, so can be identified even by observation by an SEM.

The thickness of the Sn—Zn-alloy coating is not particularly limited, but if too thin, a sufficient corrosion resistance cannot be obtained, while conversely, if too thick, there is an effect on the weldability, so a thickness of 1 to 50 μm is preferable. The method of Sn—Zn-alloy coating is not particularly limited, but for example an Sn—Zn-alloy coating is produced by hot-dipping by for example the Sendzimir method or the flux method.

Further, the surface roughness of the discontinuous $FeSn_2$ alloy phase is made 0.1 to 2.5 μm in terms of RMS. The alloy phase plays an important role in bonding the top coating layer and the base iron. If the RMS is less than 0.1 μm, the physical effect of anchoring becomes weaker and the coating bondability falls. Further, with an RMS of less than 0.1 μm, an extremely smooth state results. The solidified structure of the hot-dipping at such a smooth surface easily becomes extremely rough, segregation of Zn easily occurs at an Sn—Zn-alloy-coated steel sheet, and the corrosion resistance drops somewhat. Therefore, the RMS was made 0.1 μm or more.

On the other hand, if the RMS exceeds 2.5 μm, the interface between the alloy phase and the coating layer becomes extremely rough. The effective thickness of the Sn—Zn-alloy coating layer above it locally changes. If the coating layer is thin, the corrosion resistance inevitably falls. If the coating layer is thick, the local contact resistance at the time of spot welding becomes large, abnormal generation of heat is induced, and the weldability falls. Further, if the interface between the alloy phase and coating layer is extremely rough, the roughness of the topmost layer of the Sn—Zn-alloy coating tends to become larger as well. This is not preferable from the point of view of the appearance. Therefore, the RMS was made not more than 2.5 μm.

"RMS" means the mean square of roughness and is obtained by dividing the sum of the squares of the roughness curves in a certain section by the length of the section and obtaining the square root. It is measured by peeling off only the Sn—Zn-alloy-coating layer and measurement by a commercially available roughness meter by a method similar to that used when finding the area ratio. The $FeSn_2$ alloy phase is produced by the reaction in the hot-dip Sn—Zn-alloy coating bath. Originally, Fe and Sn have a high reactivity. Further, the Sn—Zn two-way eutectic temperature is about 200° C. Therefore, the bath temperature of the hot-dip Sn—Zn-alloy coating is made a temperature higher than that. In this bath, the Fe and Sn become alloyed in a relatively short time. However, if the bath temperature is too high or the reaction temperature is too long, the $FeSn_2$ alloy phase ends up growing thick continuously.

The formation of the $FeSn_2$ alloy phase in a continuous layer can be prevented by making the operating temperature of the hot-dip Sn—Zn-alloy coating bath preferably less than 250° C. and making the dipping time of the steel sheet in the bath less than 5 seconds. Alternatively, the method of covering the surface of the base iron before the hot-dip Sn—Zn-alloy coating by a discontinuous thin electroplated film (pre-coating film) and utilizing the difference in reaction of the parts covered by the pre-coating film and the parts not covered by it during hot-dip Sn—Zn-alloy coating. The pre-coating film is not particularly limited, but for example electroplating of Ni, Co, Cu, etc. to an amount of about 0.01 to 0.1 $g/m^2$ is possible.

In the present invention, complete corrosion resistance is expected by further post treatment of the surface of the coating layer by an inorganic compound or organic compound or a complex of the same. This treatment has extremely good affinity with the Sn—Zn-alloy coating layer. There is the effect of covering small pinholes and other defects or dissolving the coating layer to repair pinholes and greatly improves the corrosion resistance. The surface of the Sn—Zn-alloy-coating layer may be subjected to various types of post-treatment. The object is initial rust proofing, prevention of growth of the oxide film, weldability, etc. The post treatment is not particularly limited, but preferably is comprised of inorganic compounds, organic compounds, or mixtures of the same in amounts of deposition of 0.005 to 2 $g/m^2$ per surface. As the type of the film, there are an oxide film, hydroxide film, anodic oxide film, converted film, organic resin film, etc., but the type or method of production is not particularly limited. Further, as the method of treatment, treatment of a single surface, treatment of the two surfaces the same way, and treatment of the two surfaces by different ways are possible, but the present invention is not particularly limited to any of these. Any treatment is possible.

The composition of the coated plate used is not particularly limited. However, IF steel superior in workability is preferably used for the locations where high workability is required. Further, to secure the weld air-tightness, secondary workability, etc. after welding, steel sheet containing several ppm of B is preferable. For applications where workability is not required, use of Al killed steel is preferable. Further, the method of production of the steel sheet is made an ordinary method. The steel ingredients are for example adjusted by converter-vacuum degasification and melted. The slab is produced by continuous casting etc. and then hot rolled.

Further, as post treatment after coating, in addition to chromate and other conversion treatment and organic resin coating, there are also zero spangle treatment for making the appearance uniform after hot-dipping, annealing treatment for improvement of the coating, temper-rolling for adjustment of the surface conditions and material, etc. The present invention is not particularly limited to these. Other treatments may also be applied.

EXAMPLES

Example 1

Annealed, temper-rolled steel sheet of a sheet thickness of 0.8 mm was electroplated with Ni from a Watt bath to 0.1 $g/m^2$ (per side). This steel sheet was coated with a coating flux containing zinc chloride, ammonium chloride, and hydrochloric acid, then placed in a Sn—Zn hot-dipping bath. After the coating bath and surface of the steel sheet reacted, the steel sheet was taken out from the coating bath. The amount of deposition was adjusted by gas wiping to control the amount of coating deposition. The amount of coating deposition (total amount of deposition of Sn+Zn) was controlled to 40 $g/m^2$ (per side). After the gas wiping, an air jet cooler was used to solidify the hot-dip coating layer while changing the cooling rate so as to change the area ratio and arm spacing of the Sn dendrites.

To investigate the metal structure of the steel sheet, the state of distribution of Sn and Zn was analyzed by an EPMA from the coating surface layer. The area ratio of the Sn dendrites and the arm spacing of the Sn dendrites were calculated by the average of any 100 points. As one example of the invention, the solidified structure of No. 1 of Table 1 is shown in FIG. 1. The corrosion resistance of the outside surface of a tank in a salt corrosive environment is evaluated by the area ratio of occurrence of red rust after SST (Salt Spray Test) 960 hours. A red rust area ratio of 10% or less was deemed good. The corrosion resistance at the inside surface of the tank was judged by adding 10 vol % of water to forcibly degraded gasoline allowed to stand at 100° C. for a day and night in a pressure vessel to prepare a corrosive solution. A corrosion test was conducted by immersing coated steel sheet drawn with beading (sheet thickness reduction rate of 15%, 30×35 mm end face and rear face seal) in 350 ml of this corrosive solution at 45° C. for 3 weeks then measuring the type of ions and the amount of dissolution of the dissolved metal ions. An amount of dissolution of less than a total amount of metal of 200 ppm was deemed as good.

The dendrite arm spacing was made the spacing of the adjoining arms as shown together in FIG. 1 (when the arms are not parallel, the approximately center value in the long directions of the arms was used as a representative value).

The invention examples of Nos. 1 to 5 of Table 1 all had properties sufficiently able to withstand use. The comparative example of No. 6 had a low Zn wt %, so did not have a sufficient sacrificial corrosion protection effect and was somewhat inferior in corrosion resistance of the outside surface. The comparative examples of Nos. 7 and 8 had high Zn wt %, so Zn segregation was promoted with almost no precipitation of Sn dendrites any longer, so the corrosion resistances of both the inside and outside surfaces also fell.

Example 2

Cold-rolled steel sheet having a sheet thickness of 0.8 mm and given a roughness of 1.5 pn in terms of RMS was stripped of rolling oil by heating by the Sendzimir method, then the surface of the steel sheet was reduced and the steel sheet was immersed in an Sn-8 wt % Zn-alloy coating bath. "RMS" is the mean square of roughness and is obtained by dividing the sum of the squares of the roughness curves in a certain section by the length of the section and obtaining the square root. After making the coating bath and surface of the steel sheet react, the steel sheet was taken out from the coating bath and the amount of deposition adjusted by gas wiping. The amount of coating deposition (total amount of deposition of Sn+Zn) was controlled to 40 g/m$^2$ (per side).

As shown in No. 9 of Table 1, the metal structure of the steel sheet was investigated by analyzing the state of distribution of Sn and Zn from the coating surface layer by an EPMA (electron probe microanalyzer), whereupon the structure became one of two-way eutectoids burying the Sn dendrites and dendrite arm spacings. The area ratio of the Sn dendrites was 30% and the arm spacing of the Sn dendrites was 0.06 mm. The corrosion resistance of the outside surface of the tank in a salt corrosive environment was good with occurrence of white rust after SST960 hours, but no occurrence of red rust. Further, regarding the corrosion resistance of the inside surface of the tank, the metal ions dissolved were comprised of an extremely minute amount of Zn of the coating layer. The amount of dissolution was a good 15 ppm.

Example 3

Annealed, temper-rolled steel sheet of a sheet thickness of 0.8 mm was electroplated smoothly and uniformly with Ni from a Watt bath to 3.0 g/m$^2$ (per side). The steel sheet was coated with a coating flux including zinc chloride, ammonium chloride, and hydrochloric acid, then was immersed in an Sn—Zn hot-dipping bath. After making the coating bath and surface of the steel sheet uniformly react, the steel sheet was taken out from the coating bath and the amount of deposition adjusted by gas wiping. The amount of coating deposition (total amount of deposition of Sn+Zn) was controlled to 40 g/m$^2$ (per side).

Figure 2:
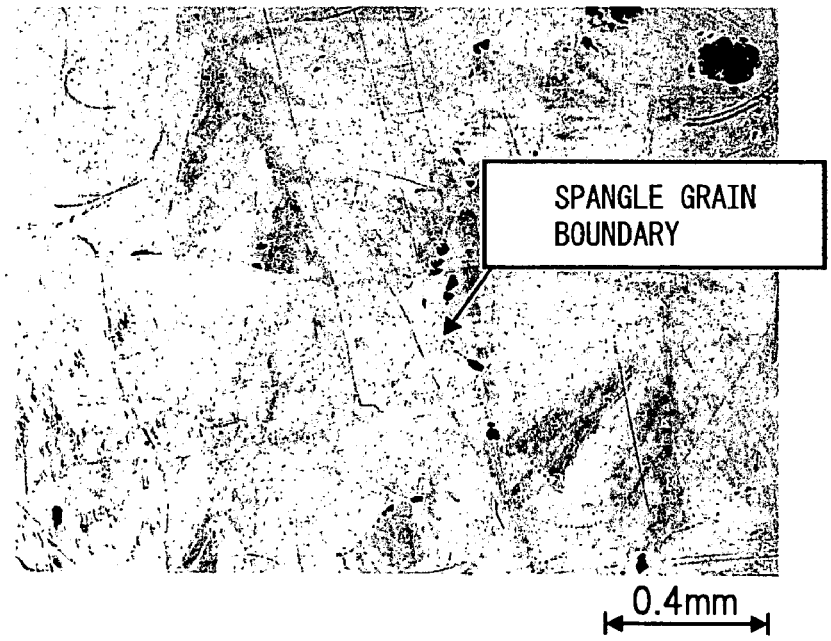
FIG. 2 is a view of a coating layer of a comparative example.

As shown in No. 10 of Table 1, the metal structure of the steel sheet was investigated by analyzing the state of distribution of Sn and Zn from the coating surface layer by an EPMA (electron probe microanalyzer), whereupon eutectic spangles of average diameters of 0.6 mm were recognized. There was no formation of Sn dendrites. Further, in this case, segregation of Zn at the grain boundary was observed (see FIG. 2). Regarding the corrosion resistance of the outside surface of the tank in a salt corrosive environment, the area ratio of occurrence of red rust after SST960 hours was 80%. A large number of pits were formed. Further, regarding the corrosion resistance of the inside surface of the tank, the metal ions dissolved were Zn and Fe, and the amount of dissolution was 180 ppm. Pitting occurred.

TABLE 1

| | | | Coating layer | | | Outside surface | Inside surface | | |
|---|---|---|---|---|---|---|---|---|---|
| No. | Ex. | Coating composition | Structure | Sn dendrite area ratio (%) | Sn dendrite arm spacing (mm) | corrosion resistance Red rust area ratio (%) | corrosion resistance Metal dissolution (ppm) | Overall evaluation | Remarks |
| 1 | 1 | Sn-8 wt % Zn | Sn dendrite + arm spacing two-way eutectoids | 40 | 0.05 | 2 | 35 | G | Inv. ex. |
| 2 | | Sn-8 wt % Zn | Sn dendrite + arm spacing two-way eutectoids | 20 | 0.08 | 5 | 70 | G | Inv. ex. |
| 3 | | Sn-8 wt % Zn | Sn dendrite + arm spacing two-way eutectoids | 10 | 0.15 | 8 | 160 | F | Inv. ex. |
| 4 | | Sn-4 wt % Zn | Sn dendrite + arm spacing two-way eutectoids | 60 | 0.06 | 7 | 25 | G | Inv. ex. |
| 5 | | Sn-2 wt % Zn | Sn dendrite + arm spacing two-way eutectoids | 80 | 0.05 | 9 | 10 | F | Inv. ex. |

TABLE 1-continued

| No. | Ex. | Coating composition | Coating layer: Structure | Coating layer: Sn dendrite area ratio (%) | Coating layer: Sn dendrite arm spacing (mm) | Outside surface corrosion resistance Red rust area ratio (%) | Inside surface corrosion resistance Metal dissolution (ppm) | Overall evaluation | Remarks |
|---|---|---|---|---|---|---|---|---|---|
| 6 | | Sn-0.5 wt % Zn | Sn dendrite + arm spacing two-way eutectoid | 95 | 0.20 | 30 | 40 | P | Comp. ex |
| 7 | | Sn-10 wt % Zn | Initial crystal Zn + Spangle two-way eutectoids | — | — | 15 | 600 | P | Comp. ex |
| 8 | | Sn-15 wt % Zn | Initial crystal Zn + Spangle two-way eutectoids | — | — | 12 | 1300 | P | Comp. ex |
| 9 | 2 | Sn-8 wt % Zn | Sn dendrite + arm spacing two-way eutectoids | 30 | 0.06 | 0 | 15 | G | Inv. ex. |
| 10 | 3 | Sn-8 wt % Zn | Spangle two-way eutectoids | — | — | 80 | 1800 | P | Comp. ex. |

Overall evaluation: G (good) . . . good corrosion resistance, F (fair) . . . usable, P (poor) . . . not usable

Example 4

Steel was melted to make a slab by ordinary converter-vacuum degasification, then was hot rolled, cold rolled, and continuously annealed under ordinary conditions to obtain annealed steel sheet (sheet thickness 0.8 mm). Suitably thereafter, it was coated by Sn—Zn by the flux method. The flux used was a $ZnCl_2$ aqueous solution coated by a roll. The composition of Zn was changed between 0 to 60 wt %. The bath temperature was made 205 to 400° C., the dipping time was made 8 second, and the amount of coating deposition was adjusted to 40 g/m$^2$ per side by wiping after coating. The performance when formed into fuel tanks was evaluated. The method of evaluation at that time was as shown below. Further, the results of evaluation of performance are shown in Table 2.

[1] Area Ratio of $FeSn_2$ Alloy Phase and RMS

Only the Sn—Zn layer of the Sn—Zn coated steel sheet was peeled off by electrolytic peeling. The electrolytic peeling was performed in a 5% NaOH solution. The current density was made 10 mA/cm$^2$. After this, the surface of the peeled surface was analyzed at any three fields by an EPMA at a power of X1000. The area ratios of production of the $FeSn_2$ alloy phases were found and the average taken. The $FeSn_2$ alloy phases exhibit specific crystal forms, so can be judged sufficiently even by an SEM. To find the area ratio more accurately, it is sufficient to measure the area where an EPMA detects the Sn element. Places where Sn is detected after electrolytic peeling show the presence of $FeSn_2$ alloy phases. The RMS of the samples with the exposed $FeSn_2$ alloy phases was measured by a commercial apparatus. This is shown by the average of the front and back surfaces. "RMS" is the mean square of roughness and is obtained by dividing the sum of the squares of the roughness curves in a certain section by the length of the section and obtaining the square root.

[2] Evaluation of Coating layer Workability

A drawing and beading test was conducted. The die at that time was one with a bead of 4R and a die type of 2R. The sample was temper-rolled by a pressing force of 1000 kg by hydraulic pressure. The width of the test piece was 30 mm. The state of the coating damage of the beaded part after drawing was examined by observation of the cross-section under a power of X400. The observed length was 20 mm. The occurrence of cracks in the coating layer was evaluated.

[Evaluation Criteria]

G (good): No defects in coating layer

F (fair): Occurrence of cracks in coating layer

P (poor): Shaping possible, but occurrence of local peeling in coating layer

[3] Corrosion Resistance Test

An SST test based on JIS Z2135 was conducted for 20 days and the state of occurrence of white rust and red rust was observed.

[Evaluation Criteria]

G (good): No occurrence of red rust, occurrence of white rust of not more than 3%

F (fair): No occurrence of red rust, occurrence of white rust of not more than 20%

P (poor): Occurrence of red rust

TABLE 2

| No. | Plating bath: Comp. (Zn wt %) | Plating bath: Bath temp. (° C.) | $FeSn_2$ phase: Area ratio (%) | $FeSn_2$ phase: RMS (μm) | Workability | Corrosion resistance | Overall evaluation | Remarks |
|---|---|---|---|---|---|---|---|---|
| 11 | 0 | 240 | 20 | 0.8 | G | P | P | Comp. ex. |
| 12 | 0 | 300 | 45 | 1.1 | G | P | P | Comp. ex. |
| 13 | 0 | 400 | 100 | 3.1 | P | F | P | Comp. ex. |
| 14 | 2 | 240 | 20 | 1.2 | G | F | G–F | Inv. ex. |
| 15 | 2 | 300 | 35 | 1.9 | G | G | G | Inv. ex. |
| 16 | 2 | 350 | 50 | 2.1 | F | G | G–F | Inv. ex. |
| 17 | 2 | 400 | 100 | 2.4 | P | F | P | Comp. ex. |
| 18 | 8 | 205 | 0.5 | 0.04 | F | F | F | Inv. ex. |
| 19 | 8 | 220 | 3 | 0.07 | G | F | G–F | Inv. ex. |
| 20 | 8 | 240 | 15 | 1.4 | G | G | G | Inv. ex. |

TABLE 2-continued

| No. | Plating bath Comp. (Zn wt %) | Plating bath Bath temp. (° C.) | $FeSn_2$ phase Area ratio (%) | $FeSn_2$ phase RMS (μm) | Workability | Corrosion resistance | Overall evaluation | Remarks |
|---|---|---|---|---|---|---|---|---|
| 21 | 8 | 300 | 40 | 1.3 | G | G | G | Inv. ex. |
| 22 | 8 | 250 | 55 | 1.8 | F | G | G–F | Inv. ex. |
| 23 | 8 | 400 | 100 | 1.9 | P | F | P | Comp. ex. |
| 24 | 15 | 300 | 30 | 1.2 | F | G | G | Comp. ex. |
| 25 | 15 | 350 | 70 | 2.0 | F | P | G–F | Comp. ex. |
| 26 | 15 | 400 | 100 | 2.2 | P | F | P | Comp. ex. |
| 27 | 25 | 350 | 90 | 1.7 | F | F | F | Comp. ex. |
| 28 | 25 | 400 | 100 | 2.4 | P | F | P | Comp. ex. |
| 29 | 35 | 350 | 100 | 2.6 | P | F | P | Comp. ex. |
| 30 | 35 | 400 | 100 | 2.8 | P | F | P | Comp. ex. |

Overall evaluation: G (good): workability and corrosion resistance both superior, F (fair): usable, P(poor): not usable In Table 2, the invention examples of Nos. 14, 15, 16, 18, 19, 20, 21, and 22 all had no problems in workability and corrosion resistance and were sufficiently satisfactory in practical properties.

On the other hand, the comparative examples of Nos. 11, 12, and 13 do not contain Zn, so are poor in sacrificial corrosion protection ability due to the drop in corrosion potential and cannot secure sufficient corrosion resistance. Further, in No. 13, the $FeSn_2$ alloy phase was produced continuously, so a drop in the workability was recognized. Nos. 17, 23, 24, 25, 26, 27, 28, 29, and 30 also ended up with production of continuous $FeSn_2$ alloy phases in the same way as No. 13, so a drop in the workability was recognized.

Further, in Nos. 29 and 30, the composition of the hot-dip Sn—Zn-alloy coating bath shifted to Zn as the main ingredient. The sacrificial corrosion protection ability by the Zn was improved, but conversely it was no longer possible to suppress the occurrence of white rust due to the Zn and excessive growth of the $FeSn_2$ alloy phase accompanying a rise in the melting point, that is, a rise in the coating bath temperature. In No. 18, the production of the $FeSn_2$ alloy phase was insufficient, the workability dropped somewhat due to the poor coating bondability, and the Sn—Zn layer became a rough solidified structure, segregation of the Zn occurred, and the corrosion resistance dropped somewhat. Further, in No. 19, the Sn—Zn layer became a rough solidified structure, segregation of the Zn occurred, and corrosion resistance dropped somewhat.

INDUSTRIAL APPLICABILITY

As explained above, the present invention enables the provision of hot-dip Sn—Zn-alloy-coated steel sheet provided with superior corrosion resistance, weldability, and workability and suitable as a material for an automobile fuel tank, household electrical appliance, or industrial machinery. Application of a toxic-free Sn-based coating to locations where Pb-based coatings had been applied up to now becomes possible.

The invention claimed is:

1. Hot-dip Sn—Zn coated steel sheet superior in corrosion resistance and workability characterized by comprising a hot-dip coating layer comprised of 1 to 8.8 wt % of Zn and the balance of Sn in an amount of 91.2 to 99.0 wt % and unavoidable impurities and/or ancillary ingredients on the surface of steel sheet, the coating surface having Sn dendrite crystals and Sn dendrite arm spacings buried by an Sn—Zn two-way eutectic structure.

2. Hot-dip Sn—Zn coated steel sheet superior in corrosion resistance and workability as set forth in claim 1, characterized in that an area ratio of Sn dendrites in the coating surface is 5 to 90%.

3. Hot-dip Sn—Zn coated steel sheet superior in corrosion resistance and workability as set forth in claim 1 or 2, characterized in that the arm spacing of the Sn dendrites is not more than 0.1 mm.

4. Hot-dip Sn—Zn coated steel sheet superior in corrosion resistance and workability as set forth in claims 1 or 2, characterized by having a discontinuous $FeSn_2$ alloy phase between the surface of the steel sheet and the hot-dip Sn—Zn-alloy coating, by having an area ratio of the $FeSn_2$ alloy phase of at least 1% and less than 100%, and having an Sn—Zn-alloy coating layer on top of that.

5. Hot-dip Sn—Zn coated steel sheet superior in corrosion resistance and workability as set forth in claim 4, characterized in that a surface roughness of said discontinuous $FeSn_2$ alloy phase is 0.1 to 2.5 μm in terms of RMS.

* * * * *

US007135237C1

(12) EX PARTE REEXAMINATION CERTIFICATE (7044th)

United States Patent

Goto et al.

(10) Number: US 7,135,237 C1

(45) Certificate Issued: Sep. 1, 2009

(54) HOT-DIPPED SN—ZN PLATING PROVIDED STEEL PLATE OR SHEET EXCELLING IN CORROSION RESISTANCE AND WORKABILITY

(75) Inventors: Yasuto Goto, Kitakyushu (JP); Shinichi Yamaguchi, Kitakyushu (JP); Masao Kurosaki, Kitakyushu (JP)

(73) Assignee: Nippon Steel Corporation, Chivoda-Ku, Tokyo (JP)

Reexamination Request:
No. 90/009,187, Jun. 16, 2008

Reexamination Certificate for:

| | |
|---|---|
| Patent No.: | **7,135,237** |
| Issued: | **Nov. 14, 2006** |
| Appl. No.: | **10/531,071** |
| Filed: | **May 13, 2005** |

(22) PCT Filed: Oct. 9, 2003

(86) PCT No.: PCT/JP03/12999

§ 371 (c)(1), (2), (4) Date: May 13, 2005

(87) PCT Pub. No.: WO2004/033745

PCT Pub. Date: Apr. 22, 2004

(30) Foreign Application Priority Data

Oct. 11, 2002 (JP) ..... 2002-298691
Oct. 11, 2002 (JP) ..... 2002-298692

(51) Int. Cl.

| | |
|---|---|
| ***B32B 15/01*** | (2006.01) |
| ***B32B 15/04*** | (2006.01) |
| ***B32B 15/18*** | (2006.01) |

(52) U.S. Cl. ..... 428/648; 428/612; 428/684

(58) Field of Classification Search ..... None
See application file for complete search history.

(56) References Cited

U.S. PATENT DOCUMENTS 6,652,990 B2 11/2003 Carey, II et al.

FOREIGN PATENT DOCUMENTS

EP 0763608 3/1997

*Primary Examiner*—Jerry D. Johnson

(57) ABSTRACT

A Pb-free hot-dip Sn—Zn coated steel sheet comprising a hot-dip coating layer comprised of 1 to 8.8 wt % of Zn and the balance of Sn in an amount of 91.2 to 99.0 wt % and unavoidable impurities and/or ancillary ingredients on the surface of steel sheet, the coating surface having Sn dendrite crystals and Sn dendrite arm spacings buried by an Sn—Zn two-way eutectic structure, an area ratio of Sn dendrites in the coating surface being 5 to 90%, and the arm spacing of the Sn dendrites being not more than 0.1 mm, preferably having a discontinuous $FeSn_2$ alloy phase at the surface of the steel sheet.

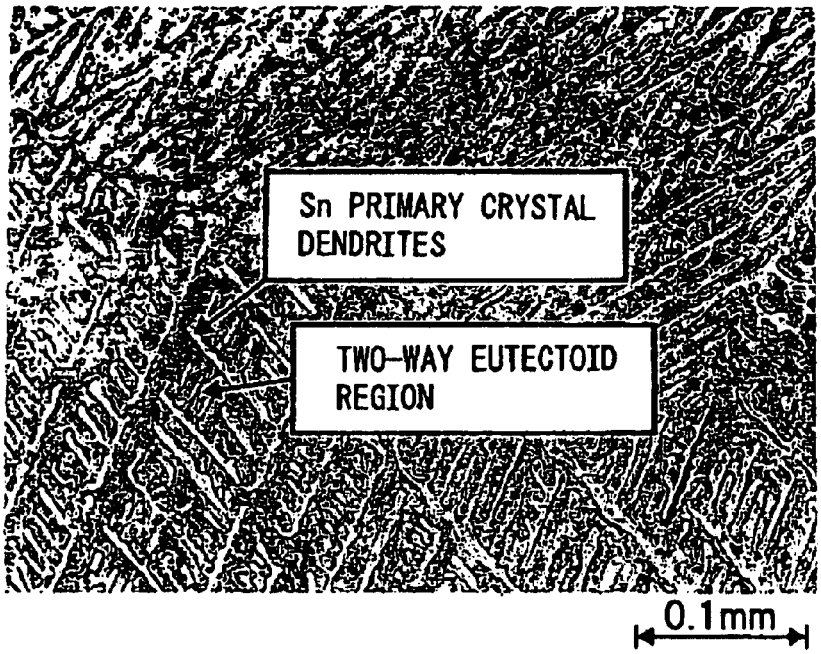

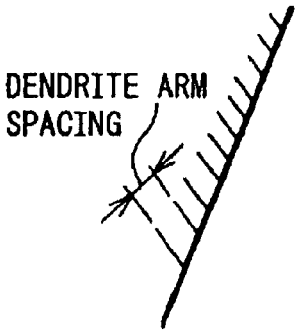

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 4 and 5 are cancelled.

Claim 1 is determined to be patentable as amended.

Claim 2, dependent on an amended claim, is determined to be patentable.

New claim 6–12 are added and determined to be patentable.

1. Hot-dip Sn—Zn coated steel sheet superior in corrosion resistance and workability characterized by comprising a hot-dip coating layer comprised of 1 to 8.8 wt % of Zn and the balance of Sn in an amount of 91.2 to 99.0 wt % and unavoidable impurities and/or ancillary ingredients on the surface of the steel sheet,

*having a discontinuous $FeSn_2$ alloy phase between the surface of the steel sheet and the hot-dip Sn—Zn coating layer at an area ratio of said discontinuous $FeSn_2$ alloy phase of 3 to 90%,*

*said discontinuous $FeSn_2$ alloy phase having a surface roughness of 0.1 to 2.5 μm in terms of RMS,* the coating surface having Sn dendrite crystals and Sn dendrite arm spacings *of not more than 0.1 mm* buried by an Sn—Zn two-way eutectic structure.

*6. Hot-dip Sn—Zn coated steel sheet according to claim 1, without a pre-coating on the surface of the steel sheet.*

*7. Hot-dip Sn—Zn coated steel sheet according to claim 1, wherein said hot-dip Sn-Zn coating layer is 20 to 150 g/m$^2$ on each side.*

*8. Hot-dip Sn—Zn coated steel sheet according to claim 1, wherein the Sn—Zn coated steel sheet has a corrosion resistant property at SST 960 hours wherein red rust area ratio is 10% or less.*

*9. Hot-dip Sn—Zn coated steel sheet superior in corrosion resistance and workability characterized by comprising a hot-dip coating layer comprised of 1 to 8.8 wt % of Zn and the balance of Sn in an amount of 91.2 to 99.0 wt % and unavoidable impurities and/or ancillary ingredients on the surface of the steel sheet,*

*having a discontinuous Ni alloy with Fe pre-coating in an amount of 0.01 to 0.1 g/m$^2$ on the surface of the steel sheet,*

*having a discontinuous $FeSn_2$ alloy phase between the surface of the steel sheet and the hot-dip Sn—Zn coating layer at an area ratio of said discontinuous $FeSn_2$ alloy phase of 3 to 90%.*

*said discontinuous $FeSn_2$ alloy phase having a surface roughness of 0.1 to 2.5 μm in terms of RMS,*

*the coating surface having Sn dendrite crystals and Sn dendrite arm spacings of not more than 0.1 mm buried by an Sn—Zn two-way eutectic structure.*

*10. Hot-dip Sn—Zn coated steel sheet according to claim 9, wherein said hot-dip Sn—Zn coating layer is 20 to 150 g/m$^2$ on each side.*

*11. Hot-dip Sn—Zn coated steel sheet according to claim 9, wherein the Sn—Zn coated steel sheet has a corrosion resistant property at SST 960 hours wherein red rust area ratio is 10% or less.*

*12. Hot-dip Sn—Zn coated steel sheet according to claim 9, characterized in that an area ratio of Sn dendrites in the coating surface is 5 to 90%.*

* * * * *